US010787296B2

(12) United States Patent
Okubo et al.

(10) Patent No.: US 10,787,296 B2
(45) Date of Patent: Sep. 29, 2020

(54) EASILY OPENABLE CONTAINER LID

(71) Applicant: NIPPON CLOSURES CO., LTD., Tokyo (JP)

(72) Inventors: Yusuke Okubo, Kanagawa (JP); Mitsuo Kumata, Kanagawa (JP)

(73) Assignee: NIPPON CLOSURES CO., LTD., Tokyo (JP)

( * ) Notice: Subject to any disclaimer, the term of this patent is extended or adjusted under 35 U.S.C. 154(b) by 122 days.

(21) Appl. No.: 15/758,658

(22) PCT Filed: Sep. 9, 2016

(86) PCT No.: PCT/JP2016/076581

§ 371 (c)(1),
(2) Date: Mar. 8, 2018

(87) PCT Pub. No.: WO2017/056918

PCT Pub. Date: Apr. 6, 2017

(65) Prior Publication Data

US 2018/0305089 A1 Oct. 25, 2018

(30) Foreign Application Priority Data

Sep. 30, 2015 (JP) ..... 2015-192884

(51) Int. Cl.
*B65D 43/26* (2006.01)
*B65D 41/42* (2006.01)
*B65D 43/02* (2006.01)

(52) U.S. Cl.
CPC ..... *B65D 41/42* (2013.01); *B65D 43/0208* (2013.01); *B65D 2543/00277* (2013.01);
(Continued)

(58) Field of Classification Search
CPC .... B65D 41/12; B65D 41/42; B65D 43/0208; B65D 2543/00277; B65D 2543/00481; B65D 2543/00601
(Continued)

(56) References Cited

U.S. PATENT DOCUMENTS 2,709,019 A 5/1955 Powell
3,206,055 A 9/1965 Helbling
(Continued)

FOREIGN PATENT DOCUMENTS

DE 3618178 12/1987
JP 63-138957 6/1988
(Continued)

OTHER PUBLICATIONS

Office Action in JP2015-192884 dated Apr. 17, 2018 with translation.

*Primary Examiner* — Elizabeth J Volz
(74) *Attorney, Agent, or Firm* — Smith, Gambrell & Russell, LLP..

(57) ABSTRACT

A container lid is configured such that repeated movement of a grip piece and a connecting piece of the lid will not break the connecting piece so that the lid can be removed easily. An extension section extends upwardly from an upper end of the connecting section along an inner peripheral surface of a skirt wall of the lid. When the container lid is on the mouth-neck section of a container, an upper end part of the extension section is sandwiched between an inner peripheral surface of the lid skirt wall and an outer peripheral surface of a locking projection on the container mouth-neck section.

7 Claims, 5 Drawing Sheets

(52) U.S. Cl.
CPC ..... *B65D 2543/00481* (2013.01); *B65D 2543/00601* (2013.01)

(58) Field of Classification Search
USPC ..... 220/269, 793; 215/305, 253, 250, 255, 215/317
See application file for complete search history.

(56) References Cited

U.S. PATENT DOCUMENTS

| | | | |
|---|---|---|---|
| 4,768,667 | A | 9/1988 | Magnusson |
| 2016/0207671 | A1 | 7/2016 | Okubo et al. |

FOREIGN PATENT DOCUMENTS

| | | | | |
|---|---|---|---|---|
| JP | 11-152159 | | 6/1999 | |
| JP | 2008-174266 | | 7/2008 | |
| JP | 2011-173594 | | 9/2011 | |
| JP | 2014-166860 | | 9/2014 | |
| JP | 2014166860 | * | 9/2014 | ..... B65D 41/32 |
| JP | 2015-40060 | | 3/2015 | |

* cited by examiner

EASILY OPENABLE CONTAINER LID

TECHNICAL FIELD

This invention relates to an easily openable container lid equipped with a shell made of a thin metal plate and a grip piece formed from a synthetic resin. The container lid is designed for a container having a mouth-neck section having an annular locking projection formed in an upper end part of an outer peripheral surface of the mouth-neck section, the annular locking projection protruding radially outwardly.

BACKGROUND ART

As disclosed in Patent Document 1 to be indicated below, a container lid having a shell made of a thin metal plate and a grip piece formed from a synthetic resin is widely put to practical use as a container lid for a container having a mouth-neck section having an annular locking projection formed in an upper end part of an outer peripheral surface of the mouth-neck section, the annular locking projection protruding radially outwardly. The shell made of a thin metal plate includes a circular top panel wall, a skirt wall hanging down from the peripheral edge of the top panel wall, and a connecting piece extending out from the lower end of the skirt wall in a predetermined region in a circumferential direction. The skirt wall and the top panel wall are formed with a pair of scores extending upwardly from the lower end of the skirt wall on both sides of the predetermined region, and extending in the top panel wall. The grip piece has a connecting section surrounding the connecting piece of the metallic shell at least partially, and a grip section extending out from the connecting section.

The container lid as described above is fitted onto the mouth-neck section of the container, and mounted on the mouth-neck section by deforming a lower end part of the skirt wall radially inwardly and locking it to the locking projection of the mouth-neck section. In unsealing the mouth-neck section, a finger is hooked over the grip section of the grip piece, and the grip piece is moved by the finger radially outwardly or upwardly to break the pair of scores. By so doing, the locking of the lower end part of the skirt wall to the locking projection of the mouth-neck section is released to remove the container lid from the mouth-neck section.

The above-described conventional container lid, however, poses the following problem: Assume that when the container lid mounted on the mouth-neck section of the container is to be removed from the mouth-neck section, the finger is hooked over the grip section of the grip piece, and the radially outward or upward movement and the radially inward or downward movement of the grip piece and the connecting piece of the shell are repeatedly performed. In this case, the connecting piece tends to be broken at a boundary between a portion of the connecting piece of the shell surrounded by the connecting section of the grip piece and a portion thereof not surrounded by the connecting section of the grip piece, thus making it markedly difficult to remove the container lid from the mouth-neck section.

To solve the above problem, Patent Document 2 to be indicated below discloses that an extension section, which extends out upwardly from the upper end of an inner surface of the connecting section of the grip piece along an inner peripheral surface of the skirt wall, is annexed to the grip piece. Such a container lid as disclosed in Patent Document 2 is not fully satisfactory, and involves the following problem: In a state where the container lid has been fitted onto the mouth-neck section of the container, the upper end of the extension section is located below an outer peripheral surface of the locking projection of the mouth-neck section. If the lower end part of the skirt wall is deformed radially inwardly, the upper end of the extension section is sandwiched between the inner peripheral surface of the skirt wall and the outer peripheral surface of the mouth-neck section at a site below the locking projection. When a finger is hooked over the grip section of the grip piece, and the grip piece is moved to some extent radially outwardly or upwardly, therefore, the extension section of the grip piece separates early from the outer peripheral surface of the mouth-neck section and becomes detached from the outer peripheral surface of the mouth-neck section. As a result, the effect ascribed to the annexation of the extension section is not fully achieved. If the grip piece and the connecting piece of the shell are repeatedly moved radially outwardly or upwardly and moved radially inwardly or downwardly, as in the container lid disclosed in Patent Document 1, the connecting piece tends to be broken at the boundary between the portion of the connecting piece of the shell surrounded by the connecting section of the grip piece and the portion thereof not surrounded by the connecting section of the grip piece, thus making the removal of the container lid from the mouth-neck section markedly difficult.

PRIOR ART DOCUMENTS

Patent Documents

Patent Document 1: JP-A-2008-174266
Patent Document 2: JP-A-2014-166860

SUMMARY OF THE INVENTION

Problems to be Solved by the Invention

The present invention has been accomplished in the light of the above facts. Its main technical challenge is to provide a novel and improved container lid configured such that even if the radially outward or upward movement and the radially inward or downward movement of the grip piece and the connecting piece of the shell are repeatedly performed when the container lid mounted on the mouth-neck section of the container is to be removed from the mouth-neck section, the connecting piece is sufficiently reliably prevented from being broken at the boundary between the portion of the connecting piece of the shell surrounded by the connecting section of the grip piece and the portion thereof not surrounded by the connecting section of the grip piece.

Means for Solving the Problems

As a result of in-depth studies and experiments, the present inventors have found that the above main technical challenge can be solved by configuring the container lid such that an extension section, which extends out upwardly from the upper end of an inner surface of the connecting section along an inner peripheral surface of the skirt wall, is provided in the grip piece; in a state where the container lid has been fitted onto the mouth-neck section, an upper end part of the extension section of the grip piece is located opposite an outer peripheral surface of the locking projection of the mouth-neck section; and in a state where a lower end part of the skirt wall has been deformed radially inwardly, the upper end part of the extension section of the grip piece is sandwiched between the inner peripheral surface of the skirt wall and the outer peripheral surface of the locking projection.

That is, according to the present invention, there is provided, as a container lid for solving the above main technical challenge, an easily openable container lid for a container having a mouth-neck section having an annular locking projection formed in an upper end part of an outer peripheral surface of the mouth-neck section, the locking projection protruding radially outwardly, the container lid comprising:

a shell made of a thin metal plate which has a circular top panel wall, a skirt wall hanging down from the peripheral edge of the top panel wall, and a connecting piece extending out from the lower end of the skirt wall in a predetermined region in a circumferential direction, and which is formed with a pair of scores extending upwardly from the lower end of the skirt wall on both sides of the predetermined region and then extending in the top panel wall; and a grip piece formed from a synthetic resin which is connected to the connecting piece, the grip piece having a connecting section surrounding the connecting piece at least partially, and a grip section extending out from the connecting section, wherein the grip piece includes an extension section extending out upwardly from the upper end of an inner surface of the connecting section along an inner peripheral surface of the skirt wall; when the container lid is fitted onto the mouth-neck section, an upper end part of the extension section of the grip piece is located opposite an outer peripheral surface of the locking projection of the mouth-neck section; and when a lower end part of the skirt wall is deformed radially inwardly, the upper end part of the extension section of the grip piece is sandwiched between the inner peripheral surface of the skirt wall and the outer peripheral surface of the locking projection.

Preferably, the outer peripheral surface of the locking projection of the mouth-neck section has a diameter gradually increased downward, and is in an arcuate shape in a vertical sectional view. Preferably, when the container lid is fitted onto the mouth-neck section, the upper end part of the extension section of the grip piece is located opposite a lower end part of the outer peripheral surface of the locking projection of the mouth-neck section and, when the lower end part of the skirt wall is deformed radially inwardly, the upper end part of the extension section of the grip piece is sandwiched between the inner peripheral surface of the skirt wall and the lower end part of the outer peripheral surface of the locking projection. Preferably, a lower surface of the locking projection of the mouth-neck section has a diameter gradually decreased downward, and is in an arcuate shape in a vertical sectional view and, if in the predetermined region the lower end part of the skirt wall is moved away from the locking projection of the mouth-neck section when the container lid mounted on the mouth-neck section is to be removed from the mouth-neck section, the upper end of the extension section of the grip piece is moved downwardly from the outer peripheral surface of the locking projection, is then brought into intimate contact with the lower surface of the locking projection or with the outer peripheral surface of the mouth-neck section below the lower surface and, when breakage of the pair of scores proceeds, is separated from the mouth-neck section. Preferably, at least the upper end part of the extension section of the grip piece is in a state of non-adhesion or weak adhesion to the inner peripheral surface of the skirt wall. It is preferred for the whole of the extension section of the grip piece to be in a state of non-adhesion or weak adhesion to the inner peripheral surface of the skirt wall. It is preferred that at least the upper end part of the extension section of the grip piece extends arcuately in the circumferential direction along the inner surface of the skirt wall, and has a wall thickness of 0.2 to 0.5 mm. It is satisfactory for at least the upper end part of the extension section of the grip piece to have a uniform thickness throughout. Preferably, the grip piece is molded from a rigid synthetic resin having a Shore D hardness of 55 to 73. Preferably, the shell is formed from a thin aluminum-based alloy plate.

Effects of the Invention

In the container lid of the present invention, the extension section, which extends out upwardly from the upper end of the inner surface of the connecting section along the inner peripheral surface of the skirt wall, is provided in the grip piece. In a state where the container lid has been fitted onto the mouth-neck section, the upper end part of the extension section of the grip piece is located opposite the outer peripheral surface of the locking projection of the mouth-neck section and, in a state where the lower end part of the skirt wall has been deformed radially inwardly, the upper end part of the extension section of the grip piece is sandwiched between the inner peripheral surface of the skirt wall and the outer peripheral surface of the locking projection. Hence, even if the radially outward or upward movement and the radially inward or downward movement of the grip piece and the connecting piece of the shell are repeatedly performed, with a finger being hooked over the grip section of the grip piece, when the container lid mounted on the mouth-neck section of the container is to be removed from the mouth-neck section, the site of the connecting piece of the shell not surrounded by the connecting section of the grip piece is lined with the extension section of the grip piece and reinforced thereby. Thus, the site of the connecting piece of the shell not surrounded by the connecting section of the grip piece is inhibited from being excessively bent and sufficiently prevented from being broken. On the other hand, when the lower end part of the skirt wall is somewhat removed from the outer peripheral surface of the locking projection of the mouth-neck section, in the circumferential predetermined region where the grip piece is present, the extension section of the grip piece is separated radially inwardly from the inner surface of the skirt wall and displaced radially inwardly and downwardly, while the upper end of the extension section moves away from the outer peripheral surface of the locking projection of the mouth-neck section and makes intimate contact with the lower surface of the locking projection or the outer peripheral surface of the mouth-neck section below the locking projection, particularly if at least the upper end part of the extension section of the grip piece is in a state of no-adhesion or weak adhesion to the inner surface of the skirt wall. When the grip piece is further moved radially outwardly or upwardly, the leading end of the extension section functions as a so-called fulcrum of a lever to help the grip piece move radially outwardly or upwardly.

MODE FOR CARRYING OUT THE INVENTION

The present invention will now be described in further detail by reference to the accompanying drawings showing a preferred embodiment of an easily openable container lid configured in accordance with the present invention.

Figure 1:
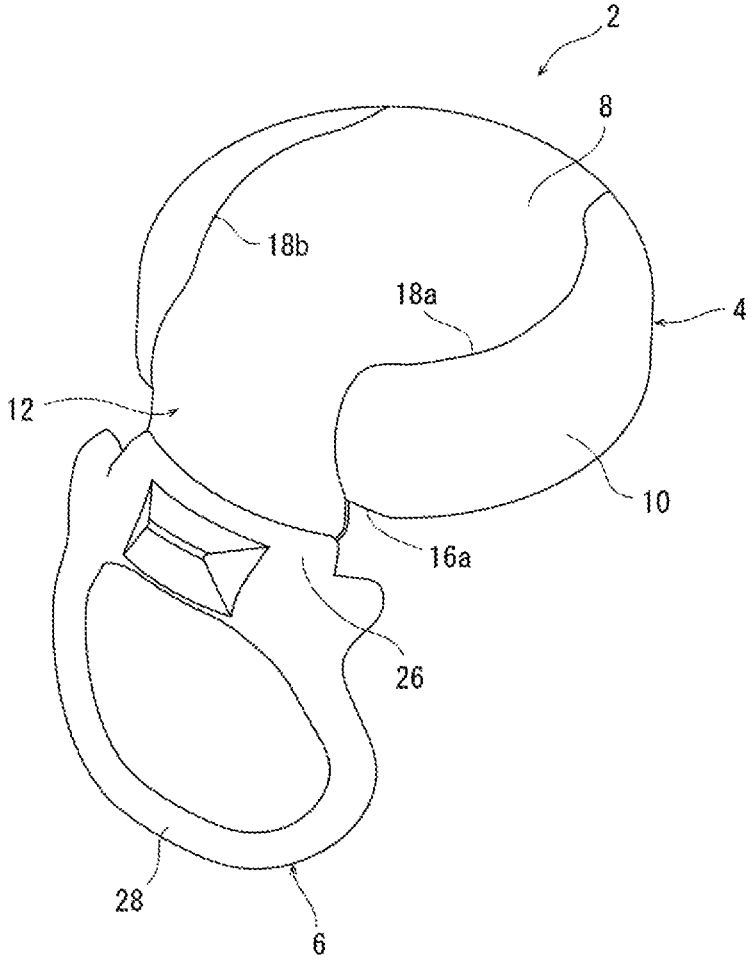
FIG. 1 is a perspective view of a preferred embodiment of a container lid configured in accordance with the present invention.
Figure 2:
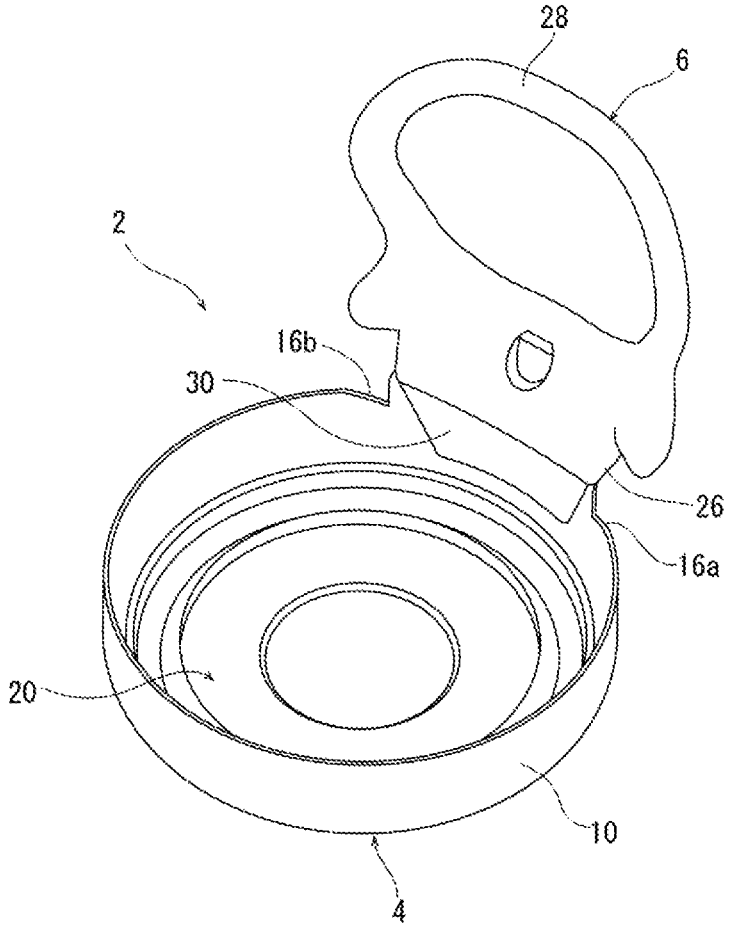
FIG. 2 is a perspective view of the container lid shown in FIG. 1 which is in an inverted state.
Figure 3:
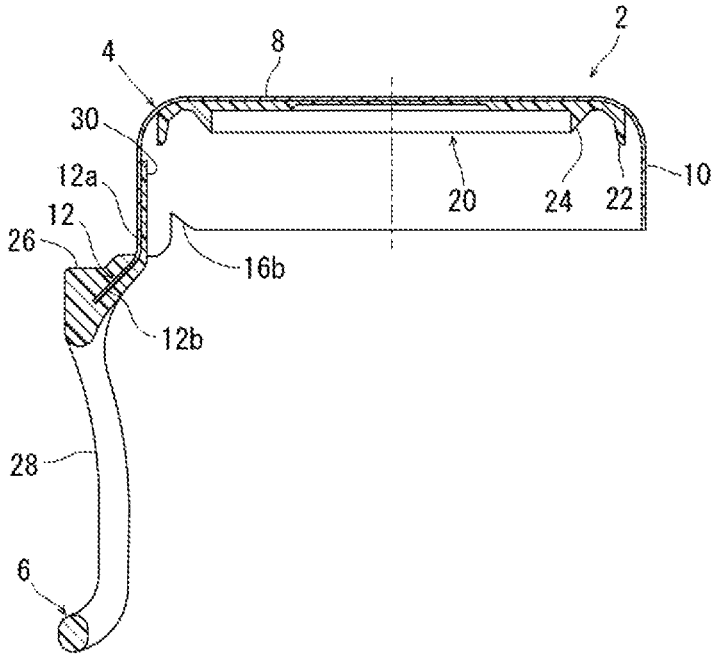
FIG. 3 is a sectional view of the container lid shown in FIG. 1.

With reference to FIGS. 1 to 3, the illustrated container lid, entirely indicated at 2, is equipped with a shell 4 made of a thin metal plate, and a grip piece 6 formed from a synthetic resin.

The shell 4 is composed of a circular top panel wall 8, a cylindrical skirt wall 10 hanging down from the peripheral edge of the top panel wall 8, and a connecting piece 12 extending out from the lower end of the skirt wall 10 in a predetermined region in a circumferential direction. A main portion of the top panel wall 8 extends substantially horizontally, a main portion of the skirt wall 10 extends substantially vertically, and a boundary region between the top panel wall 8 and the skirt wall 10 extends radially outwardly and downwardly in an arcuate shape in FIG. 3 which is a vertical sectional view. The connecting piece 12 has a vertical section 12*a* extending substantially vertically downwardly from the lower end of the skirt wall 10, and an inclined section 12*b* extending out downwardly, while slanting radially outwardly, in succession to the vertical section 12*a*. On both sides of the predetermined region where the connecting piece 12 is disposed, notches 16*a* and 16*b* are formed in a lower end part of the skirt wall 10. Scores 18*a* and 18*b*, as a pair, extending from the notched 16*a* and 16*b*, respectively, are formed in the skirt wall 10 and the top panel wall 8. Each of the paired scores 18*a* and 18*b* has a first part extending from the lower end of the skirt wall 10 to the upper end of the skirt wall 10 in succession to the notch 16*a* or 16*b*, a second part extending in a peripheral edge portion of the top panel wall 8 following the first part, and a third part following the second part and further extending out into the skirt wall 10. The shell 4 as described above can be integrally formed by applying suitable machining, such as punching or drawing, to a suitable thin metal plate such as a thin aluminum-based alloy plate, a chromic acid-treated thin steel plate, or a thin tin plate. The paired scores 18*a* and 18*b* can be formed by making a tool act on the thin metal plate from its face or back, thereby reducing its thickness.

As will be understood by referring to FIGS. 2 and 3, a liner 20 is disposed on an inner surface of the top panel wall 8 of the shell 4. The liner 20 is formed by supplying a suitable synthetic resin material, such as flexible polyethylene, to the inner surface of the top panel wall 8 of the shell 4, and embossing the synthetic resin material with a desired shape. The liner 20 is disk-shaped as a whole, and has two annular ridges, i.e., an outer annular ridge 22 and an inner annular ridge 24, in a peripheral edge portion thereof.

Further referring to FIGS. 1 to 3, the grip piece 6 has a connecting section 26 surrounding the connecting piece 12 of the shell 4 at least partially, and a grip section 28 extending out from the connecting section 26. In the illustrated embodiment, the connecting section 26 of the grip piece 6 surrounds most of the inclined section 12*b* of the connecting piece 12. The so configured grip piece 6 is injection-molded or compression-molded from a suitable synthetic resin material such as polypropylene or polyethylene, preferably a synthetic resin having a Shore D hardness of 55 to 73, with the use of the connecting piece 12 of the shell 4 as a so-called core, and can thereby be coupled to the connecting section 26 simultaneously with the molding.

In the container lid 2 of the present invention, it is important for the grip piece 6 to include an extension section 30 extending out upwardly over a required length along an inner peripheral surface of the skirt wall 10 from the upper end of an inner surface of the connecting section 26. Advantageously, the extension section 30 extends arcuately in a circumferential direction along the inner peripheral surface of the skirt wall 10, and at least an upper end part of the extension section 30, preferably the entire extension section 30, has a thickness of the order of 0.2 to 0.5 mm. In the illustrated embodiment, the circumferential length of the extension section 30 gradually decreases upward, and the extension section 30 is in a trapezoidal shape as a whole. It is important that the length of upward extension of the extension section 30 be a dimension which establishes such a relation that the upper end part of the extension section 30 is locked to a locking projection of a mouth-neck section of a container on which the container lid 2 is to be mounted. For example, the upward extension length of the extension section 30 is advantageously of the order of 5 to 6 mm. It is important that the connecting section 26 of the grip piece 6 be firmly connected to the connecting piece 12 of the shell 4. Thus, the connecting section 26 is desirably joined to the connecting piece 12, while the extension section 30 of the grip piece 6 is preferably in a state of non-adhesion or weak adhesion to the inner peripheral surface of the skirt wall 10. To bring the extension section 30 into the state of non-adhesion or weak adhesion to the inner peripheral surface of the skirt wall 10, it is recommendable, for example, to apply a coating, which is non-adherent or weakly adherent to the synthetic resin material making up the grip piece 6, to the site of the thin metal plate forming the shell 4 which the extension section 30 is located to oppose, before molding the grip piece 6 with the use of the connecting piece 12 of the shell 4 as a so-called core. To the site of the connecting piece 12 surrounded by the connecting section 26 of the grip piece 6, it is possible to apply a coating having adhesiveness to the synthetic resin material forming the grip piece 6.

Figure 4:
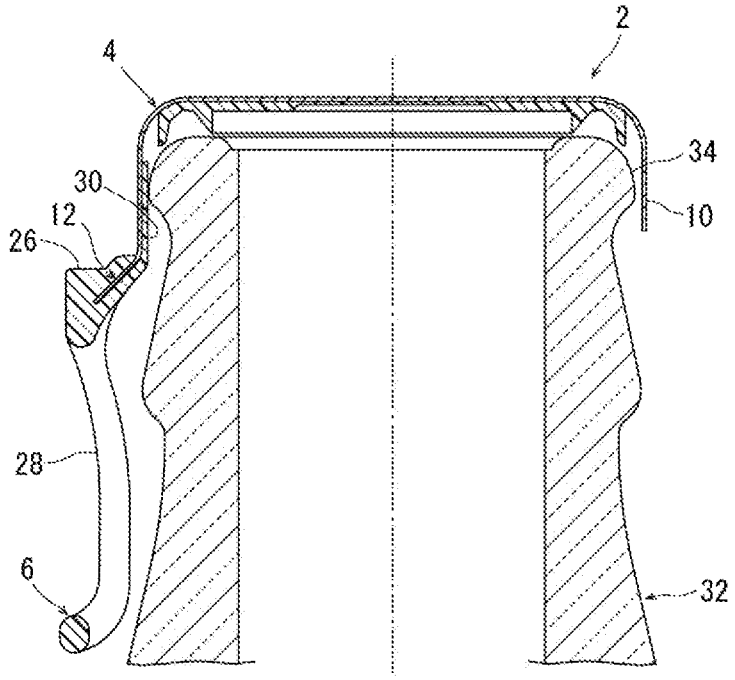
FIG. 4 is a view showing a state in which the container lid shown in FIG. 1 has been fitted onto a mouth-neck section.

FIG. 4 shows, together with the container lid 2, a mouth-neck section 32 of a container fitted with the container lid 2. The mouth-neck section 32 of the container, which can be formed from glass or a suitable synthetic resin such as polyethylene terephthalate, is in a nearly cylindrical shape as a whole, and an upper end part of its outer peripheral surface is formed with an annular locking projection 34 protruding radially outwardly. The outer peripheral surface of the locking projection 34 of the mouth-neck section 32 has a diameter gradually increased downward, and is in an arcuate shape in a vertical sectional view. A lower surface of the locking projection 34 of the mouth-neck section 32 has a diameter gradually decreased downward, and is in an arcuate shape in a vertical sectional view. Am arcuate concavity is formed in a region ranging from the lower surface of the locking projection 34 to the outer peripheral surface of the mouth-neck section 32 below this lower surface.

Figure 5:
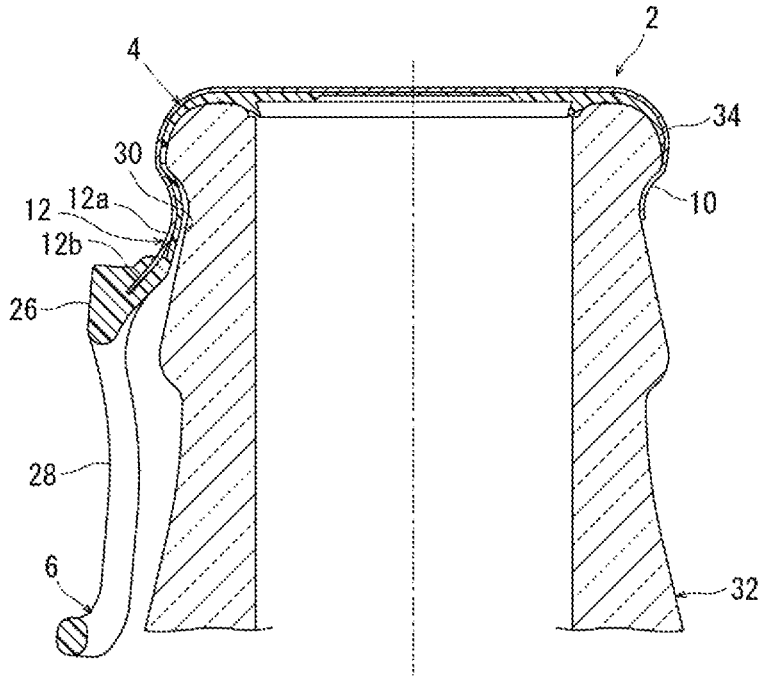
FIG. 5 is a view showing a state in which a lower end part of a skirt wall has been deformed radially inwardly from the state shown in FIG. 4.

To mount the container lid 2 on the mouth-neck section 32 of the container, it is important that the upper end part of the extension section 30 of the grip piece 6 be located above the lower end of the locking projection 34 of the mouth-neck section 32 and opposite the outer peripheral surface of the locking projection 34, with the container lid 2 being fitted onto the mouth-neck section 32 as illustrated in FIG. 4. In the illustrated embodiment, the upper end of the extension section 30 of the grip piece 6 is located opposite a lower end part of the outer peripheral surface of the locking projection 34 of the mouth-neck section 32. In mounting the container lid 2 on the mouth-neck section 32 of the container filled with beer or a gas-containing liquid such as a carbonated beverage, the container lid 2 is fitted onto the mouth-neck section 32 as illustrated in FIG. 4, and then a lower part of the skirt wall 10 of the shell 4 is deformed radially inwardly, with the container lid 2 being kept pressed downward as illustrated in FIG. 5, whereby the lower part of the skirt wall 10 is locked to the locking projection 34 of the mouth-neck section 32. By so doing, the upper end part of the extension section 30 of the grip piece 6 is sandwiched between the inner peripheral surface of the skirt wall 10 and the outer peripheral surface of the locking projection 34 and, in the illustrated embodiment, between the inner peripheral surface of the skirt wall 10 and the lower end part of the outer peripheral surface of the locking projection 34.

Figure 6:
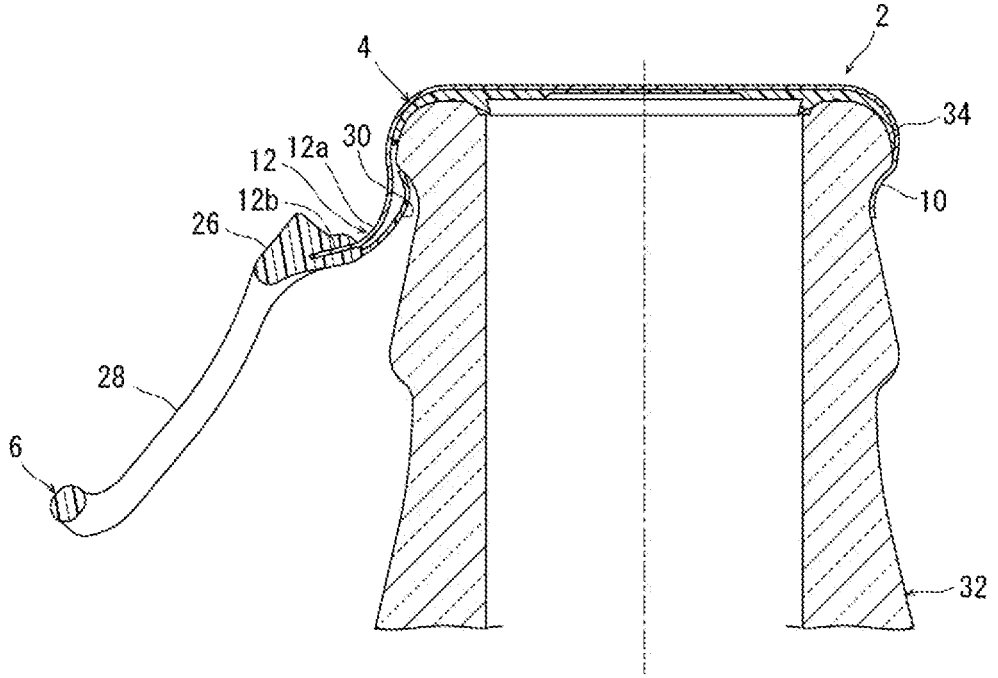
FIG. 6 is a view showing a state in which a grip piece has been somewhat moved radially outwardly or upwardly from the state shown in FIG. 5.
Figure 7:
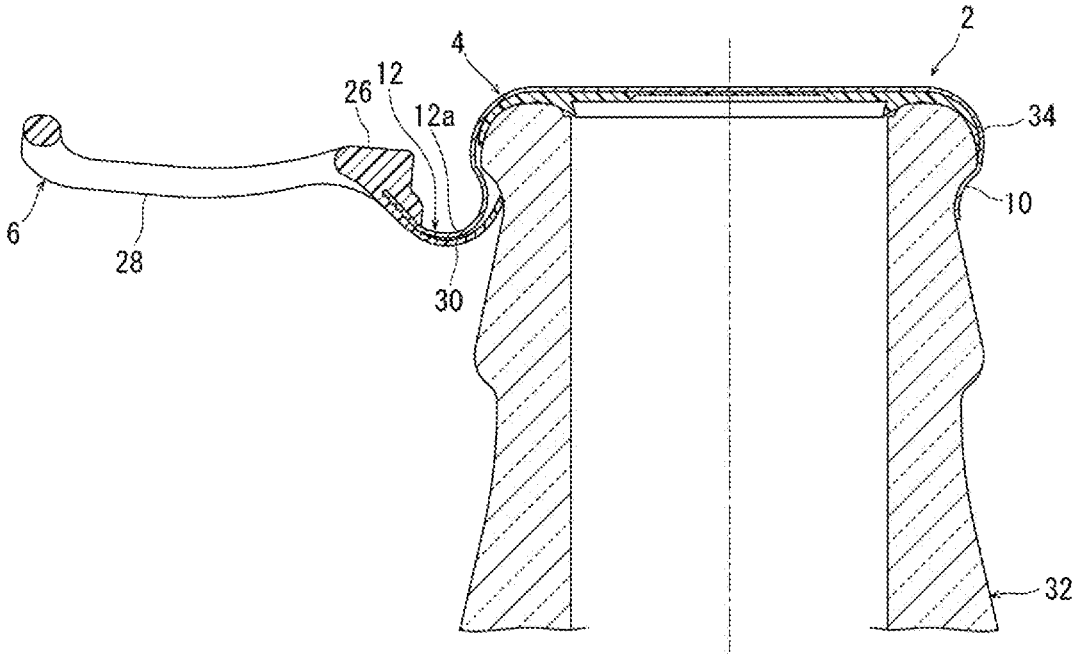
FIG. 7 is a view showing a state in which the grip piece has been further moved radially outwardly or upwardly from the state shown in FIG. 6.

In removing the container lid 2 from the mouth-neck section 32 to unseal the mouth-neck section 32 for consumption of the contents, a finger is hooked over the grip section 28 in the grip piece 6 of the shell 4 to move the grip piece 6 radially outwardly or upwardly, as illustrated in FIG. 6. Even if, on this occasion, an undesirable operation is performed, namely, the radially outward or upward movement of the grip piece 6 and the radially inward or downward movement of the grip piece 6 are repeatedly performed, the portion in the connecting piece 12 of the shell 4 which is not surrounded by the connecting section 26 of the grip piece 6, namely, the vertical section 12*a* or the boundary between the vertical section 12*a* and the inclined section 12*b*, is lined with and reinforced with the extension section 30 of the grip piece 6. Thus, the portion in the connecting piece 12 of the shell 4 which is not surrounded by the connecting section 26 of the grip piece 6 is inhibited from being excessively bent there, and is sufficiently prevented from being broken there. Assume that, in the above-mentioned predetermined region, the lower end part of the skirt wall 10 is moved away from the locking projection 34 of the mouth-neck section 32 by moving the grip piece 6 radially outwardly or upwardly. In this case, if at least the upper end part of the extension section 30 of the grip piece 6 is in a state of non-adhesion or weak adhesion to the inner surface of the skirt wall 10, at least the upper end part of the extension section 30 of the grip piece 6 is released from sandwiching between the inner peripheral surface of the skirt wall 10 and the outer peripheral surface of the locking projection 34, is then moved downward from the outer peripheral surface of the locking projection 34, and is finally brought into intimate contact with the lower surface of the locking projection 34, or with the arcuate concavity in the outer peripheral surface of the mouth-neck section 32 below this lower surface, as illustrated in FIGS. 6 and 7. When the grip piece 6 is further moved radially outwardly or upwardly, breakage of the paired scores 18*a* and 18*b* formed in the shell 4 proceeds. As a result, the locking of the lower end part of the skirt wall 10 of the shell 4 to the annular locking projection 34 of the mouth-neck section 32 is released, and the container lid 2 is removed from the mouth-neck section 32. During the radially outward or upward movement of the grip piece 6, the leading end of the extension section 30 in intimate contact with the lower surface of the locking projection 34 or the outer peripheral surface of the mouth-neck section 32 below this lower surface functions as a so-called fulcrum of a lever, promoting the radially outward or upward movement of the grip piece 6. When the breakage of the paired scores 18*a* and 18*b* proceeds, the extension section 30 is separated from the mouth-neck section 32.

EXPLANATIONS OF LETTERS OR NUMERALS

2: Container lid
4: Shell
6: Grip piece
8: Top panel wall
10: Skirt wall
12: Connecting piece
18*a*, 18*b*: A pair of scores
26: Connecting section
28: Grip section
30: Extension section
32: Mouth-neck section
34: Locking projection

The invention claimed is:

1. An easily openable container lid for a container having a mouth-neck section having an annular locking projection formed at an upper end part of the mouth-neck section, the locking projection having an outer peripheral surface protruding radially outwardly to have, in a vertical sectional view, an arcuate shape with a diameter gradually increasing downwardly, and having a lower surface with a diameter gradually decreasing downwardly, the container lid comprising:

a shell made of a thin metal plate which has a circular top panel wall, a skirt wall hanging down from a peripheral edge of the top panel wall, and a connecting piece extending out from a lower end of the skirt wall in a predetermined region in a circumferential direction, the shell being formed with a pair of scores extending upwardly from the lower end of the skirt wall on both sides of the predetermined region to the top panel wall;

a grip piece formed from a synthetic resin which is connected to the connecting piece, the grip piece having a connecting section surrounding the connecting piece at least partially, and a grip section extending out from the connecting section; and an extension section extending out upwardly from an upper end of an inner surface of the connecting section along an inner peripheral surface of the skirt wall, wherein when the container lid is fitted onto the mouth-neck section, an upper end part of the extension section is located opposite the outer peripheral surface of the locking projection, when a lower end part of the skirt wall is deformed radially inwardly, the upper end part of the extension section becomes sandwiched between the inner peripheral surface of the skirt wall and the outer peripheral surface of the locking projection, and when the lower end part of the skirt wall is moved away from the locking projection while the container lid is removed from the mouth-neck section, the upper end part of the extension section moves downwardly along the locking projection outer peripheral surface into intimate contact with the lower surface of the locking projection or with the mouth-neck section below the locking projection lower surface, whereby when breakage of the pair of scores proceeds, the upper end part of the extension section separates from the mouth-neck section.

2. The container lid according to claim 1, wherein at least the upper end part of the extension section of the grip piece is in a state of non-adhesion or weak adhesion to the inner peripheral surface of the skirt wall.

3. The container lid according to claim 2, wherein a whole of the extension section of the grip piece is in the state of non-adhesion or weak adhesion to the inner peripheral surface of the skirt wall.

4. The container lid according to claim 1, wherein at least the upper end part of the extension section of the grip piece extends arcuately in the circumferential direction along an inner surface of the skirt wall, and has a wall thickness of 0.2 to 0.5 mm.

5. The container lid according to claim 4, wherein at least the upper end part of the extension section of the grip piece has a uniform thickness throughout.

6. The container lid according to claim 1, wherein the grip piece is molded from a rigid synthetic resin having a Shore D hardness of 55 to 73.

7. The container lid according to claim 1, wherein the shell is formed from a thin aluminum-based alloy plate.

* * * * *